US005984011A

United States Patent [19]

Misselbrook et al.

[11] Patent Number: 5,984,011

[45] Date of Patent: Nov. 16, 1999

[54] METHOD FOR REMOVAL OF CUTTINGS FROM A DEVIATED WELLBORE DRILLED WITH COILED TUBING

[75] Inventors: John G. Misselbrook, Houston, Tex.; Graham B. Wilde, Calgary, Canada

[73] Assignee: BJ Services, USA, Houston, Tex.

[21] Appl. No.: 09/034,528

[22] Filed: Mar. 3, 1998

[51] Int. Cl.[6] ..... E21B 21/10

[52] U.S. Cl. ..... 166/312; 175/61

[58] Field of Search ..... 175/61, 62, 215, 175/73, 95; 166/311, 312

[56] References Cited

U.S. PATENT DOCUMENTS

| | | | |
|---|---|---|---|
| 5,215,151 | 6/1993 | Smith et al. | 175/45 |
| 5,322,391 | 6/1994 | Fisk | 175/73 |
| 5,394,951 | 3/1995 | Pringle et al. | 175/61 |
| 5,417,291 | 5/1995 | Leising | 175/320 |
| 5,485,889 | 1/1996 | Gray | 175/61 |

*Primary Examiner*—Frank Tsay

*Attorney, Agent, or Firm*—Butler & Binion, LLP; Sue Z. Shaper

[57] ABSTRACT

Method and apparatus for removing drill cuttings from a deviated wellbore drilled with coiled tubing, and more particularly method and apparatus for removing "cuttings beds" from a significantly horizontal wellbore drilled with a downhole motor by creating flow of fluid in the wellbore at a critical flow rate, above a flow rate range designed for the drilling.

13 Claims, 2 Drawing Sheets

S
P2
P1
R
CT
I
CT BOP
WH
WB
CT
CT
F
A
WB
BHA
B
M
V
D
CB

METHOD FOR REMOVAL OF CUTTINGS FROM A DEVIATED WELLBORE DRILLED WITH COILED TUBING

FIELD OF INVENTION

This invention relates to methods and apparatus for removing cuttings from a "deviated" wellbore drilled with coiled tubing, and more particularly, to removing "cuttings beds" created when a downhole motor is used in significantly horizontal drilling.

BACKGROUND OF INVENTION

"Deviated" and/or "horizontal" wells, or portions of wells, are frequently drilled using a downhole motor run on coiled tubing. Coiled tubing offers advantages when under-balanced drilling, when drilling through slim boreholes and when drilling through completions. The term "deviated" as used herein refers to any well with a significant deviation from the vertical, such that gravity can create a "cuttings bed" problem of any dimension.

A downhole drilling motor is typically powered by drilling fluid pumped down the drill string. The drilling fluid is pumped through the motor, which thereby powers a drilling element or bit, and out through the bit to cool the bit and to remove drill cuttings by recirculation uphole.

Drilling deviated and especially "horizontal" wells can result in a "cuttings bed" problem. This "cuttings bed" problem is not encountered in this form in vertical wellbores. Cuttings in deviated or horizontal wells, even though carried by the drilling fluid away from the bit tend to settle eventually beneath the drill string in a deviated or horizontal segment. This problem is largely avoided with a surface drive drill string by the constant turning of the drill pipe in the hole. The cuttings removal process is further enhanced with tubulars by the flex of jointed pipe between the joints during rotation.

Cuttings form what is referred to as "cuttings beds" on the lower side of non-rotating drill string in deviated portions of a wellbore. Buildup of "cuttings beds" leads to undesirable friction and possibly to the sticking of the drill string. In coiled tubing drilling, to illustrate the problem, a typical horizontal well may have a diameter of 4¾ inches. A coiled tubing drill string may have a typical outside diameter of 2⅞ inches. There is not, therefore, a great expanse of area in which a cuttings bed can freely collect without obstructing the freedom of movement needed for the drill string. Thus, any cuttings bed should periodically be removed when drilling deviated wells with coiled tubing.

When drilling fluid is used to power a downhole drilling motor, the motor itself places limits on the permissible range of fluid flow rates therethrough. Excessive flow rates could damage the motor. The flow rate limits, thus, of a downhole drilling motor are generally considered to place one set of limits on the maximum fluid flow rate permissible down the drill string.

More importantly, with coiled tubing used as the drill string, the surface pressure used for pumping fluid down the tubing if the tubing is being reeled and unreeled places a second, perhaps more significant, set of limits on the maximum fluid flow rate desirable down the drill string.

Tubing suitable for drilling, coiled on a reel of approximately 10 feet in diameter, has been plastically deformed beyond its "yield point". Reeling and unreeling require bending the tubing. Bending shortens the tubings' useful life. Reeling coiled tubing under a significant pressure differential aggreviates the effects of bending on the "fatigue life" of the tubing. The greater the pressure differential the greater the adverse effect on fatigue life. This reduced fatigue life is reflected, in turn, in the cost for a job. The higher the differential pressure under which the tubing will be bent, the significantly shorter the overall useful life of the string. An operation that significantly reduces the lifetime of the tubing will be directly reflected in increased costs. As a consequence, significantly increasing internal coiled tubing pressure at surface, while simultaneously reeling the tubing, as in drilling, may improve fluid flow rate downhole, and may improve cuttings return, but can have a significantly adverse effect upon the cost of a job.

Given the above considerations, the present practice in the industry to cure the "cuttings bed" problems in "horizontal" wells is to perform "wiper trips". For a "wiper trip" the drill string is pulled back along the well, pulling the bit through the horizontal section of the well. Dragging the bit stirs up cuttings from any "bed" and permits the drilling fluid to transport the cuttings up the well. However, dragging the bit can damage its gauge side and dragging the bit while rotating further reams the hole. And although wiper trips can cure a "cuttings bed" problem, they are expensive in the time and equipment they consume. In some wells wiper trips can consume 50% or more of the time of drilling. At a cost of up to $40,000 per day for a coiled tubing drilling rig and associated equipment, this is a significant expense. Alternate solutions are valuable.

The use of muds with special viscosifiers is also practiced in the industry to enhance a "cuttings transport" characteristic of a drilling fluid. However even with specially viscosified drilling fluids, cuttings still settle to form a "cuttings bed" in horizontal wells drilled with a downhole motor. Wiper trips are still required. Thus, although improving the cuttings carrying characteristics of a drilling fluid can delay the settling rate of cuttings, it will not eliminate a cuttings bed from forming in time.

To add a further complicating factor, the use of such special viscosifiers may not always be possible. Horizontal drilling may be performed "under-balanced". Although drilling is typically performed "over-balanced," where a drilling fluid is selected such that the hydrostatic head from the fluid "over-balances" the pressures expected from any downhole formations, "under-balanced" drilling is a growing practice, particularly in horizontal wells because it can be less damaging to sensitive formations. In "under-balanced" drilling the hydrostatic head of the drilling fluid is designed to be exceeded by the pressures expected from the formations downhole. Under-balanced drilling is typically achieved by adding a gas such as nitrogen to a drilling fluid such as water. Drilling under "under-balanced" conditions further limits the ability to maximize a cuttings transport characteristic of a drilling fluid by adding viscosifiers.

A key aspect of the present invention includes establishing, and using apparatus to establish, in a wellbore for a significant period of time a high enough fluid flow rate to create a "critical level" of flow for fluids transporting cuttings through at least a deviated or horizontal portion of the wellbore. Study of cuttings beds problems shows that if a fluid transporting cuttings achieves what is referred to as a "critical" level of flow, a flow that may for instance exhibit a critical level of momentum transfer, especially if this critical level of flow occurs while further cuttings are not being created, then essentially all of a "cuttings bed" can be cleared from a horizontal wellbore in quite a competitive period of time. It has been estimated, for instance, that a removal rate of approximately one foot per second (or sixty feet per minute) can be achieved by "critical flow" without drilling. Ceasing drilling during this period of critical level of flow is compatible both with not creating further cuttings and with not reeling coiled tubing when it is placed under quite high deferential pressure at surface.

Pulling a drill string for a wiper trip typically does not proceed at a rate greater than fifty feet per minute, and usually proceeds slower. Also further time is consumed with wiper trips in returning the string to the drilling position. Hence, removing cuttings using a critical-level-of-flow method offers the promise of saving valuable time. Further, using a critical-level-of-flow method offers the advantage of avoiding wear and tear on the drill string and bit occasioned by pulling in and out with wiper trips, and offers the advantage of not reducing further the lifetime of the coiled tubing by reeling it in and out in a wiper trip, at whatever differential pressure.

Indications are that a "critical level" of flow for drilling fluid in a horizontal well typically occurs at a rate of 3 to 5 feet-per-second. Such a flow rate raises three problems which the instant invention addresses. This critical level of flow is frequently above the maximum flow rate prescribed for fluid flow through a downhole motor. Establishing the critical level of flow may exceed the capacity of the drilling fluid pump. And most importantly, the critical level of flow typically requires surface pressures that would significantly shorten the normal lifetime of coiled tubing if applied while unreeling the tubing.

The instant invention includes, therefore, in preferred embodiments, a downhole circulating valve of adequate size for bypassing at least a portion of the fluid pumped downhole around the drilling motor, preferably into the region of the wellbore proximate the motor. The instant invention also includes holding coiled tubing stationary during periods of increased fluid flow rate. In such cases, all or a majority, of the fluid would be preferably directed to bypass the drill motor. The apparatus also includes in a preferred embodiment being prepared to use at least two pumps located at the surface connected to the coiled tubing such that surface pressure on the drilling fluid can be increased at least two-fold. (The relationship of surface pressure to wellbore fluid flow rate is discussed subsequently.) By so significantly increasing the pressure on the drilling fluid at the surface, and by diverting at least a portion if not all, of the fluid flow downhole from or around the drill motor, and, in addition by avoiding unreeling the coiled tubing during periods of unusually high surface pressure used to achieve the elevated flow rate downhole, circulating fluid can be used effectively to remove cuttings beds.

Studies indicate that if fluids of either the same composition as the drilling fluid or of an alternative composition, are pumped in a deviated or horizontal portion of a wellbore at at least 120% of the fluid flow rate typically used for drilling, such pumping produces wellbore flow rates at a "critical" level. Such flow rates result in a comparatively rapid removal of "cuttings beds" from a horizontal wellbore, especially if drilling is discontinued and no new cuttings are being created. Not only can "cuttings beds" thereby be removed without wiper trips but also the rate of removal of the beds can exceed that of wiper trips, e.g. approximate a linear foot a second. Studies indicate that increasing the flow rate of fluid into the wellbore from 20% to 50% of the normal drilling flow rate will increase the rate of removal of cuttings beds from 2 fold to 4 fold.

Coiled tubing drillers will likely provide and have on hand a primary drilling fluid pump with horsepower and pumping ranges that comfortably exceed anticipated drilling needs. A back up pump should also be on site. The present invention anticipates the possibility of mobilizing both of these pumps in order to achieve the heightened pumping rates on surface necessary to generate a critical flow of drilling fluids in a deviated or horizontal portion of a wellbore. As a rough rule of thumb, increasing flow rate in a horizontal portion of a wellbore by a multiple of X should require an $X^2$ increase of pump pressure on surface and an $X^3$ increase of horsepower in the pump. Thus, raising a downhole flow rate from R to 3/2R may require raising the pressure of the drilling fluid on surface from P to 9/4P, or to 2.25P, which may require a pump horsepower of 27/8 HP, or about 3.4 HP, where HP is the normal horsepower used for drilling (e.g. used for producing pressure P and flow rate R). The availability and mobilization of larger than normal pumps and/or multiple pumps, thus, comprises an aspect of the apparatus disclosed herein.

A coiled tubing drill string when drilling a horizontal portion of a well will likely predominatly lie, due to gravity, on the lower side of the horizontal wellbore. During drilling the weight of the coiled tubing will be "held" at surface and "managed" to maximize drilling performance, or rate of penetration. Only partial weight, typically, is "set down" on the bit while drilling. While not drilling, the weight-on-bit can be managed to enhance cuttings bed removal. Cuttings bed removal in a horizontal portion of a wellbore may be enhanced if the string is encouraged to helix in the wellbore rather than to lie predominantly on the lower side of the wellbore. Helixing of coiled tubing in the wellbore may be encouraged by managing the weight-on-bit, and in particular by likely setting down more weight. One aspect of the present invention involves managing the weight-on-bit to enhance cuttings bed removal.

SUMMARY OF THE INVENTION

The present invention covers method and apparatus for removing drill cuttings from a deviated wellbore. The method includes drilling a wellbore with coiled tubing; ceasing drilling while pumping fluid down the tubing into the wellbore at a flow rate greater than a flow rate range used for drilling; and removing cuttings from a portion of the wellbore by circulating at least a portion of the pumped fluid up the wellbore.

In preferred embodiments the drilling uses a downhole drilling motor powered by the drilling fluid and the method includes valving at least a portion, if not all, of the fluid pumped downhole to bypass the drilling motor. Alternate embodiments could adopt a drill motor such that the motor could withstand higher fluid flow rates, at least if perhaps the motor were not drilling. Preferably, however, a valve to by-pass fluid around the motor would be used.

Pumping fluids downhole into the wellbore preferably pumps fluids into the vicinity of the motor for recirculation through deviated or horizontal portions to the surface. In a preferred embodiment the coiled tubing remains stationary while pumping at the surface at an enhanced or greater flow rate. Ceasing drilling preferably includes ceasing to rotate the drilling element at a drilling speed, thereby ceasing to create new cuttings and not further reaming the hole.

The method is envisioned to include pumping fluid down tubing to achieve a rate of at least 120% of the fluid flow rates used for drilling with 150% often desirable. In preferred embodiments ceasing drilling while pumping at the higher flow rates is anticipated to occupy at least 10% of the total time of horizontal drilling.

The method includes managing the weight on bit of the coiled tubing while not drilling to increase the helixing of the tubing in the wellbore. Likely such management of the weight-on-bit includes setting down more weight than is used during drilling.

The present invention also comprises preferred apparatus which includes coiled tubing attached to a bottomhole assembly. The bottomhole assembly includes a drill motor in fluid communication with the coiled tubing and a valve. The valve is located in a path of fluid communication between the tubing and the motor and is structured to vent at least a portion of fluid pumped downhole, if not all, to bypass the motor and into a region outside the bottomhole assembly. The valve should preferably permit a flow rate of at least 1 barrel per minute. At the surface one or more pumps are connected to the coiled tubing for providing pressurized fluid and preferably for operating at at least 175% of the horsepower used for the drilling.

BRIEF DESCRIPTION OF THE DRAWINGS

The invention will be better understood and objects other than set forth above, will become apparent when consideration is given to the following detailed description thereof. Such description makes reference to the annexed drawings wherein.

DETAILED DESCRIPTION OF PREFERRED EMBODIMENTS

"Horizontal" and/or "deviated" are used herein to indicate a wellbore that is significantly not vertical, such that a "cuttings bed" is likely to form under a drill string. A drilling element is typically a bit but the invention is relevant for other drilling elements that produce drill cuttings that form "cuttings beds".

When drilling is ceased during a cuttings bed removal phase, it may be sufficient if the drilling element just ceases drilling, and thus ceases to create significant new cuttings. This would be independent of whether or not the element actually ceases rotating. Rotating a drilling element during this phase without drilling might be an option, although the most effective procedure would appear to be to cease rotating the bit and motor altogether.

Figure 1:
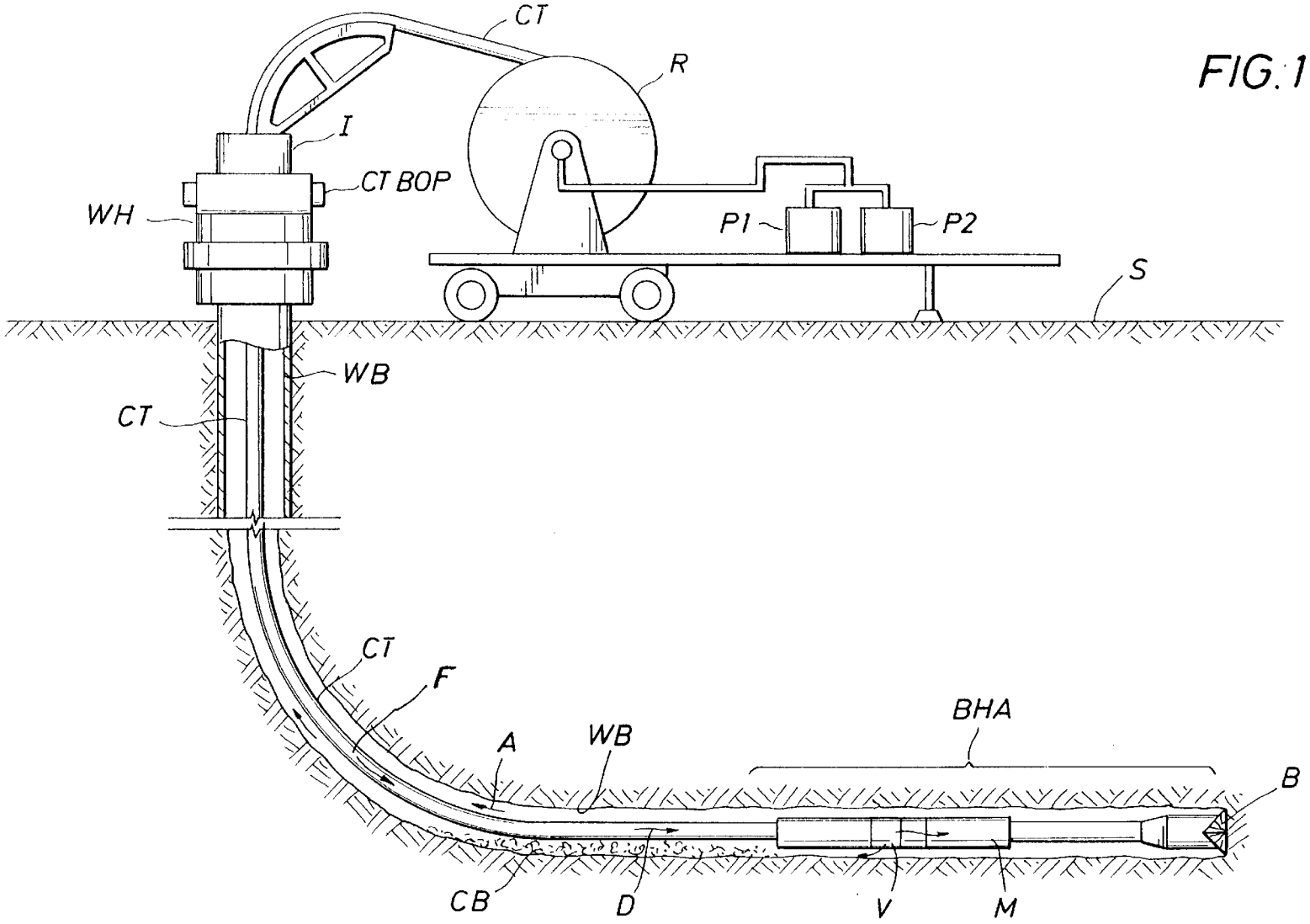
FIG. 1 illustrates method and apparatus for removing drill cuttings from a horizontal wellbore.

FIG. 1 illustrates coiled tubing CT being reeled from reel R at surface S through injector I, through coiled tubing blowout preventer CT BOP, through wellhead WH and down wellbore WB. Tubing CT turns into a deviated portion of wellbore WB and is attached to a bottomhole assembly BHA. The bottomhole assembly has motor M and terminates in bit B. Fluid F is illustrated as pumped down tubing CT to bottomhole assembly BHA by one or both pumps P1 and P2. A cuttings bed CB is illustrated as built up under a portion of tubing CT in a horizontal portion of wellbore WB. Bottomhole assembly BHA is shown with valve V, which valve may or may not be part of another BHA tool and/or of motor M. Valve V can divert or separate all fluid F, or a portion of the fluid F, pumped downhole. Valve V should be structured to be able to vent at least a portion of the fluid from the tubing to bypass the drill motor into the region of the bottomhole assembly. Preferably the venting occurs at at least a flow rate of 1 barrel per minute.

In a preferred embodiment a horizontal portion of wellbore WB is drilled with a downhole drilling motor M. Periodically the method includes ceasing drilling while pumping fluid F downhole into wellbore WB at a flow rate exceeding the flow rate ranges appropriate to and used while drilling. Pumping at such enhanced flow rate may be facilitated by use of a second pump at surface, possibly a back up pump, to provide the necessary horsepower and may be facilitated by use of a circulating valve downhole on the BHA. The method includes ceasing drilling, which ceases generating new cuttings, and removing drill cuttings from horizontal portions of the wellbore by circulating fluid pumped at at least a critical flow rate. The cuttings are circulated up the wellbore, in the direction indicated by arrow A.

In one embodiment the method includes valving with valve V at least a portion of the fluid pumped downhole, and preferably substantially all the fluid, to bypass drilling motor M. Venting downhole into the wellbore at valve V pumps fluid into the vicinity of motor M. Preferably coiled tubing CT remains stationary while pumping at the flow rate greater than the flow rate gauge used for drilling.

In preferred embodiments pumping fluid while ceasing drilling includes pumping fluid down tubing CT at a rate of at least 120% of a fluid flow rate used for drilling, and possibly at 150% of a fluid flow rate used for drilling. Also in preferred embodiments, ceasing drilling while pumping fluid downhole occupies at least 10% of the total time of horizontal drilling.

Figure 2A:
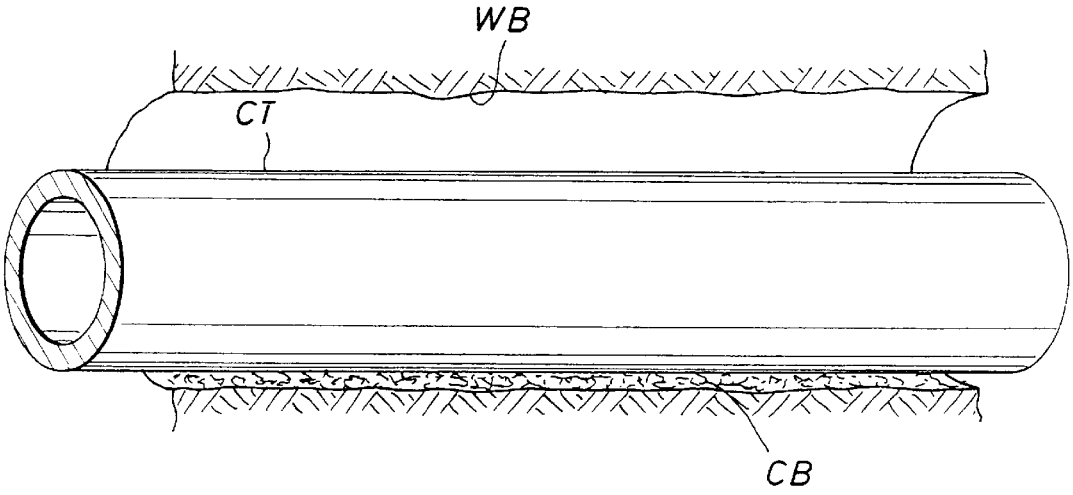
FIGS. 2A and 2B illustrate a likely location of coiled tubing in a horizontal wellbore during drilling and likely drilling fluid flow paths in the tubing.
Figure 2B:
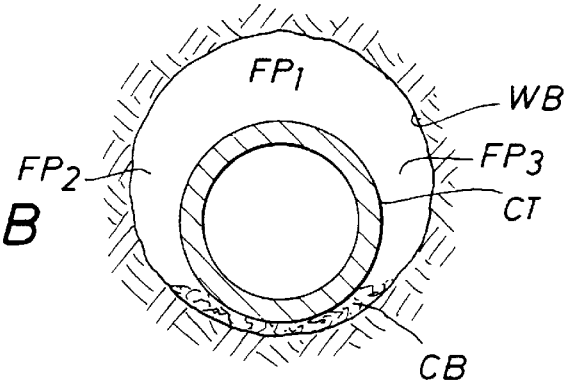

FIGS. 2A and 2B illustrate a typical alignment of coiled tubing CT in a substantially horizontal wellbore WB during drilling. The end view indicated by FIG. 2B illustrates three flow paths for the drilling fluid back up the well. These flow paths are indicated as FP1, FP2 and FP3. The drilling fluid tends to follow the path of least resistance FP1 in the horizontal portion of the well. The drilling fluid tends to avoid the narrowing flow paths FP2 and FP3. There is greater resistance to flow in flow paths FP2 and FP3 because of greater surface area presented to the fluid and thus greater friction inhibiting flow. FIGS. 2A and 2B illustrate the resting of coiled tubing on the bottom of wellbore WB, which could be anticipated while drilling horizontally with coiled tubing and which enhances the tendency of a cuttings bed to collect on the bottom of the wellbore and not to be swept up hole by the flow or the circulation of the drilling fluid backup hole.

Figure 3A:
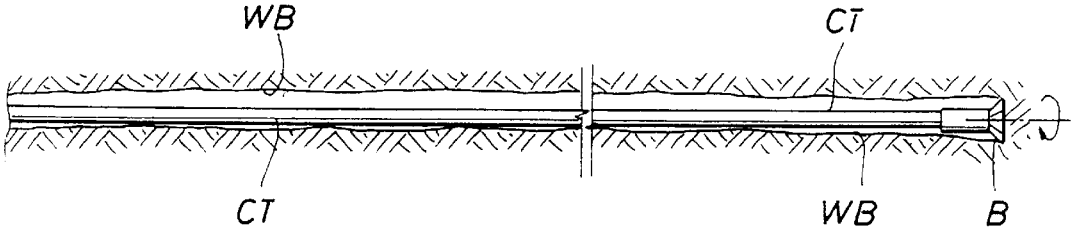
FIG. 3 illustrates a helixed configuration of coiled tubing in a horizontal wellbore due to managing the weight-on-bit.
Figure 3B:
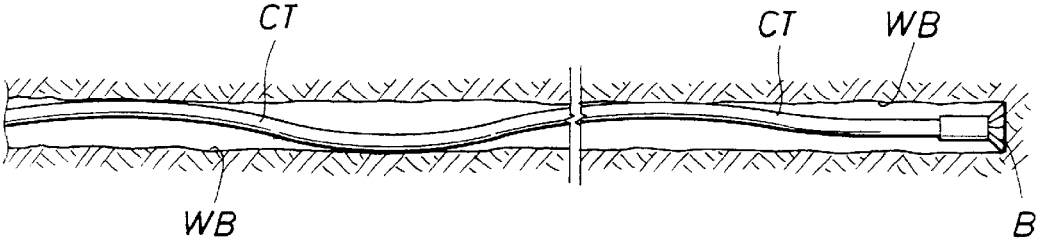

FIGS. 3A and 3B illustrate the possibility of alleviating the problem with respect to cuttings bed caused by the coiled tubing tending to lie along the bottom of a substantially horizontal wellbore during drilling. FIG. 3A illustrates a typical drilling phase of a horizontal well with coiled tubing. Bit B is illustrated as turning and coiled tubing CT is illustrated largely lying along the lower portion of wellbore WB, as illustrated in FIGS. 2A and 2B. In FIG. 3B drilling has ceased. Bit B is illustrated as having ceased turning. Not only are no new drill cuttings being generated but the weight on bit from the coiled tubing can now be managed in order to optimize the configuration of the coiled tubing CT in the wellbore WB for a cuttings bed removal phase. Coiled tubing CT is shown helixed now within wellbore WB. Such helixing of the coiled tubing can likely be effected by managing the weight of the coiled tubing on bit B and in wellbore WB. More particularly, simply setting down more weight of the coiled tubing on bit B likely leads to the helixing of the coiled tubing in the wellbore WB. Such helixing lifts substantial portions of the coiled tubing off of the lower section the wellbore WB where the cuttings beds have collected. Drilling considerations should largely prohibit so managing the weight-on-bit to helix the coiled tubing in a horizontal portion of the wellbore while drilling.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A method for removing drill cuttings from a deviated wellbore, comprising:

drilling a wellbore with coiled tubing;

ceasing drilling while pumping fluid down the tubing into the wellbore at a flow rate exceeding a flow rate range used for drilling; and removing cuttings from a portion of the wellbore by circulating at least a portion of the pumped fluid up the well.

2. The method of claim 1 wherein the drilling uses a downhole drilling motor powered by drilling fluid.

3. The method of claim 2 that includes valving at least a portion of fluid pumped downhole to bypass the drilling motor.

4. The method of claim 2 wherein pumping downhole into the wellbore pumps fluid into the vicinity of the motor.

5. The method of claim 1 wherein the coiled tubing remains stationary while pumping at a flow rate exceeding the drilling rate range.

6. The method of claim 1 wherein ceasing drilling includes ceasing to rotate a drilling element at a drilling speed.

7. The method of claim 1 wherein pumping fluid includes pumping fluid down tubing at a rate of at least 120% of a fluid flow rate used for drilling.

8. The method of claim 1 wherein ceasing drilling while pumping fluid downhole occupies at least 10% of the time of drilling in a substantially horizontal well.

9. The method of claim 1 that includes managing the weight of the coiled tubing while pumping to increase the helixing of the tubing in the wellbore while drilling.

10. The method of claim 9 wherein managing the weight includes setting down weight.

11. Apparatus for drilling deviated wells with coiled tubing, comprising:

coiled tubing attached to a bottom hole assembly (BHA);

a drill motor attached to the BHA in fluid communication with the coiled tubing;

a valve attached to the BHA, the valve located in a path of fluid communication between the tubing and the motor and structured to vent at least a portion of fluid from the path, by-passing the motor, to a region outside the BHA; and one or more pumps supplying pressurized fluid to the coiled tubing at surface, the one or more pumps operating at at least 175% of the horsepower used for drilling.

12. The apparatus of claim 11 wherein the valve is structured to vent at least a barrel per minute.

13. The apparatus of claim 11 wherein the one or more pumps are operating at at least 250% of the horsepower used for drilling.

* * * * *